US006745441B1

(12) United States Patent
Lin

(10) Patent No.: US 6,745,441 B1
(45) Date of Patent: Jun. 8, 2004

(54) LOCKING PLIERS

(76) Inventor: Li-Chieh Lin, No.44-47, Han Nan Street, Wen Te Village, Hua Tan Hsiang, Chang Hua Hsien (TW)

( * ) Notice: Subject to any disclaimer, the term of this patent is extended or adjusted under 35 U.S.C. 154(b) by 0 days.

(21) Appl. No.: 10/313,468

(22) Filed: Dec. 4, 2002

(51) Int. Cl.[7] ..... A41F 1/00

(52) U.S. Cl. ..... 24/505; 24/502; 81/328; 100/234

(58) Field of Search ..... 29/30.5 R, 67.3, 29/67.5, 67.7, 67.9, 67 R, 489, 495, 513, 498–508, 517–520, 565, 568, 570, 576; 100/234; 81/318–320, 323–325; 606/116, 117, 136–138, 151, 157, 153, 154, 205–207

(56) References Cited

U.S. PATENT DOCUMENTS 1,185,654 A * 5/1916 Eifel ..... 81/319
1,772,428 A * 8/1930 Palotce ..... 81/319
4,538,485 A * 9/1985 Saila ..... 81/336
4,602,535 A * 7/1986 Wiener et al. ..... 81/313
4,787,279 A * 11/1988 Undin ..... 81/313
6,116,124 A * 9/2000 Ping ..... 81/385
6,178,855 B1 * 1/2001 Bally et al. ..... 81/355
6,240,815 B1 * 6/2001 Huang ..... 81/328
6,308,597 B1 * 10/2001 Stahle ..... 81/319
6,336,386 B1 * 1/2002 Lee ..... 81/328
6,564,703 B1 * 5/2003 Lin ..... 100/234

* cited by examiner

*Primary Examiner*—J. J. Swann
*Assistant Examiner*—Ruth C. Rodriguez
(74) *Attorney, Agent, or Firm*—Charles E. Baxley

(57) ABSTRACT

A locking pliers comprising a first arm and a second arm, a main rivet joins the two arms together in cross; a tensile spring wraps around the main rivet with two legs inside the two handles respectively; a teeth bar with one end joins moveably inside the joint of the first arm, the other end stretches downward into the handle of the second arm; a control mechanism located inside the first handle with a teeth structure on one side to gear into the teeth of the teeth bar and to offer an elastic strength to pull the teeth bar toward the protuberance, the other side stretches out of the handle of the second arm for users to adjust. Users can apply the present invention to clamp an object for more convenient, less strength and more stable clamping effect.

7 Claims, 10 Drawing Sheets

LOCKING PLIERS

BACKGROUND OF THE INVENTION

I. Field of the Invention

This invention relates generally to a locking pliers and, more specifically, to a locking pliers that clamps an object with convenience, prompt, safety and ease of operation.

II. Description of the Prior Art

Heretofore, it is known that a prior locking pliers has right and left two clamping arms, on one end of each clamping arm is the handle, the other end is the clamping portion: two clamping arms are joined in cross with a pivot; a tensile spring spans over two handles. Two clamping portions clamp an object, when users release the handle to ease the tensile spring, the clamping portions open. Users have to maintain gripping strength to overcome the elasticity of the tensile spring, therefore users must grip harder and maintain gripping strength through out the clamping operation, the object might drop with ease of gripping strength; after certain period of time, users' hands get tired and might not be able to maintain proper gripping strength and unable to clamp the object stably.

SUMMARY OF THE INVENTION

It is therefore a primary object of the invention to provide a locking pliers that is designed to meet human's operation for more convenient, less strength and more stable clamping effect.

In order to achieve the objective set forth, a locking pliers in accordance with the present invention comprises a first arm with a joint in hollow center, two sides of the first arm is a jaw and a handle; a second arm with a joint in hollow center, two sides of the second arm is a jaw and a handle; a main rivet joins the first arm and the second arm together in cross; a tensile spring wraps around the main rivet with two legs inside the two handles respectively; a teeth bar in rectangular shape with one end joins moveably inside the joint of the first arm, the other end stretches downward into the handle of the second arm; a protuberance is the inner wall of the handle of the second arm for the back of the teeth bar to lean on; a control mechanism with a teeth structure on one side to gear into the teeth of the teeth bar and to offer an elastic strength to pull the teeth bar toward the protuberance, the other side stretches out of the handle of the second arm for users to adjust.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
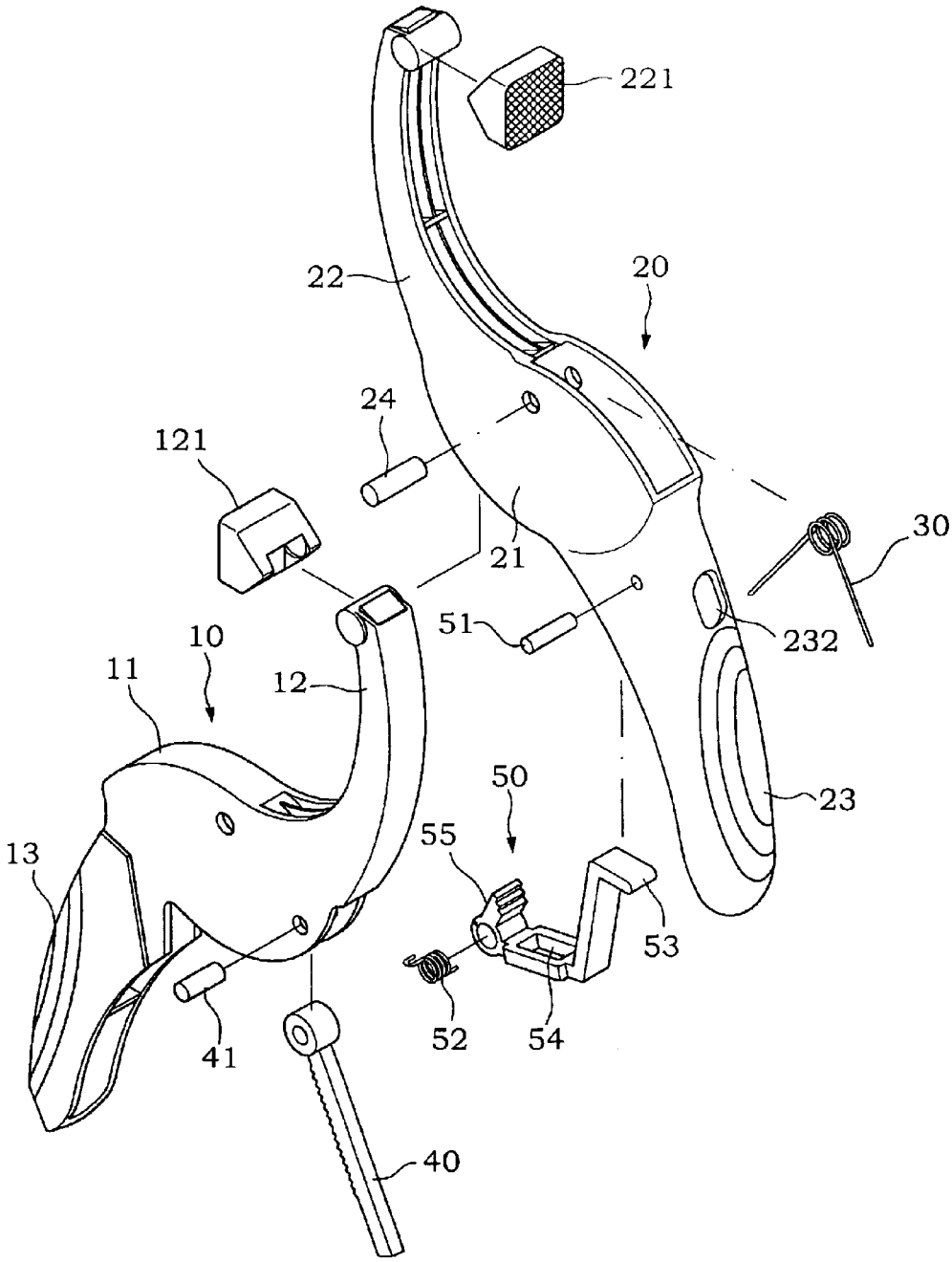
FIG. 1 is an assembly view of the first application the present invention.
Figure 2:
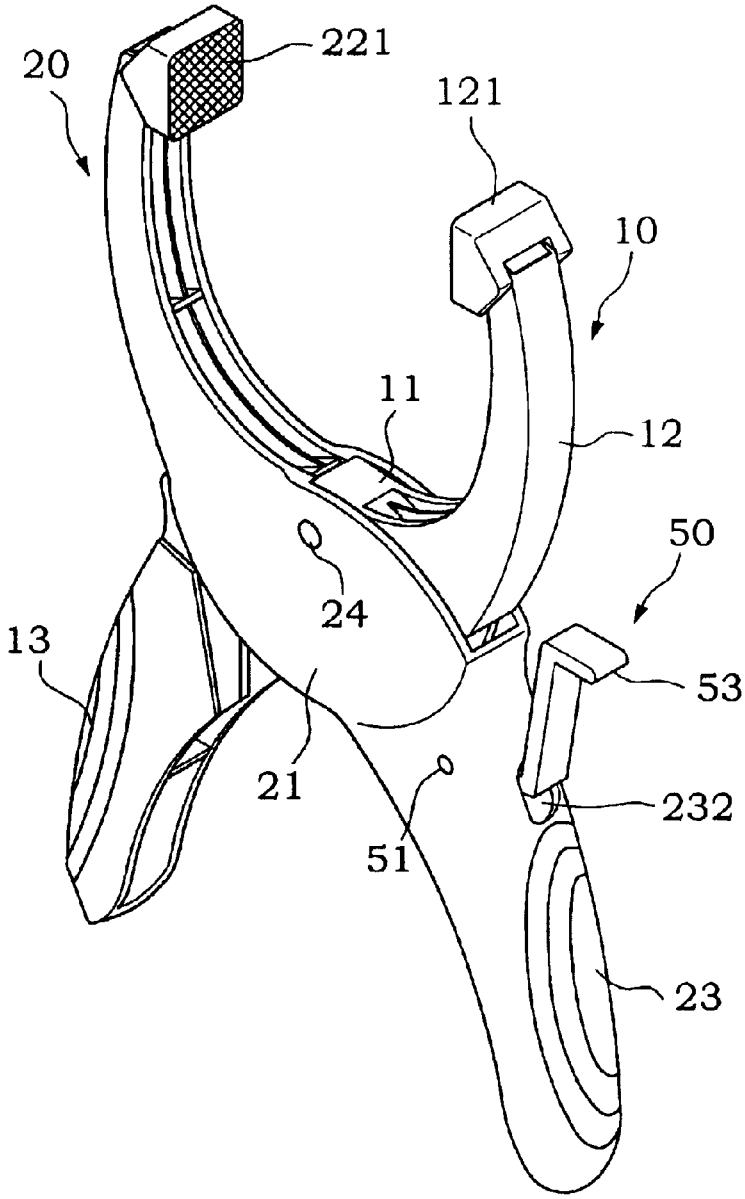
FIG. 2 is a perspective of the first application of the present invention.

Referring to FIG. 1, FIG. 2, FIG. 4 and FIG. 5 the present invention is composed of following:

- a first arm (10) with a joint (11) in hollow center, two sides of the first arm (10) is a jaw (12) and a handle (13); a jaw tip (121) in on the open end of the jaw (12);
- a second arm (20) with a joint (21) in hollow center, two sides of the second arm (20) is a jaw (22) and a handle (23); a jaw tip (221) in on the open end of the jaw (22); a main rivet (24) joins the first arm (10) and the second arm (20) together on the joint (11) and the joint (21);
- a tensile spring (30) wraps around the main rivet (24) with two legs inside the handle (13) and handle (23) respectively;
- a teeth bar (40) in rectangular shape with one end joins moveably inside the joint (11) of the first arm (10) with a rivet (41), the other end stretches downward into the handle (23) of the second arm (20); a protuberance (231) is the inner wall of the handle (23) of the second arm (20) for the back of the teeth bar (40) to lean on;
- a control mechanism (50) with a teeth structure (55) on one side to gear into the teeth of the teeth bar (40) and to offer an elastic strength to pull the teeth bar (40) toward the protuberance (231), the other side stretches out of the handle (23) of the second arm (20) for users to adjust. The first application as shown in FIG. 3A, FIG. 3B and FIG. 3C, the front of the control mechanism (50) is linked moveably to the handle (23) that face the teeth side of the teeth bar (40) with a rivet (51) and a spring (52), one leg of the spring (50) is fixed to the control mechanism (50), the other leg is fixed into a small hole (not shown in FIG) on the wall of the handle (23); the end of the control mechanism (50) passes through a hole (232) of the handle (23) and bent upward to form an adjust part (53), the middle of the control mechanism (50) has a long hole (54) for the teeth bar (40) to pass through and swing; the teeth structure (55) of the control mechanism (50) faces the teeth bar (40), the teeth structure (55) normally gears into the teeth of the teeth bar (40) by the elastic strength of the spring (52), the teeth bar (40) is also pulled toward the protuberance (231).

Figure 6A:
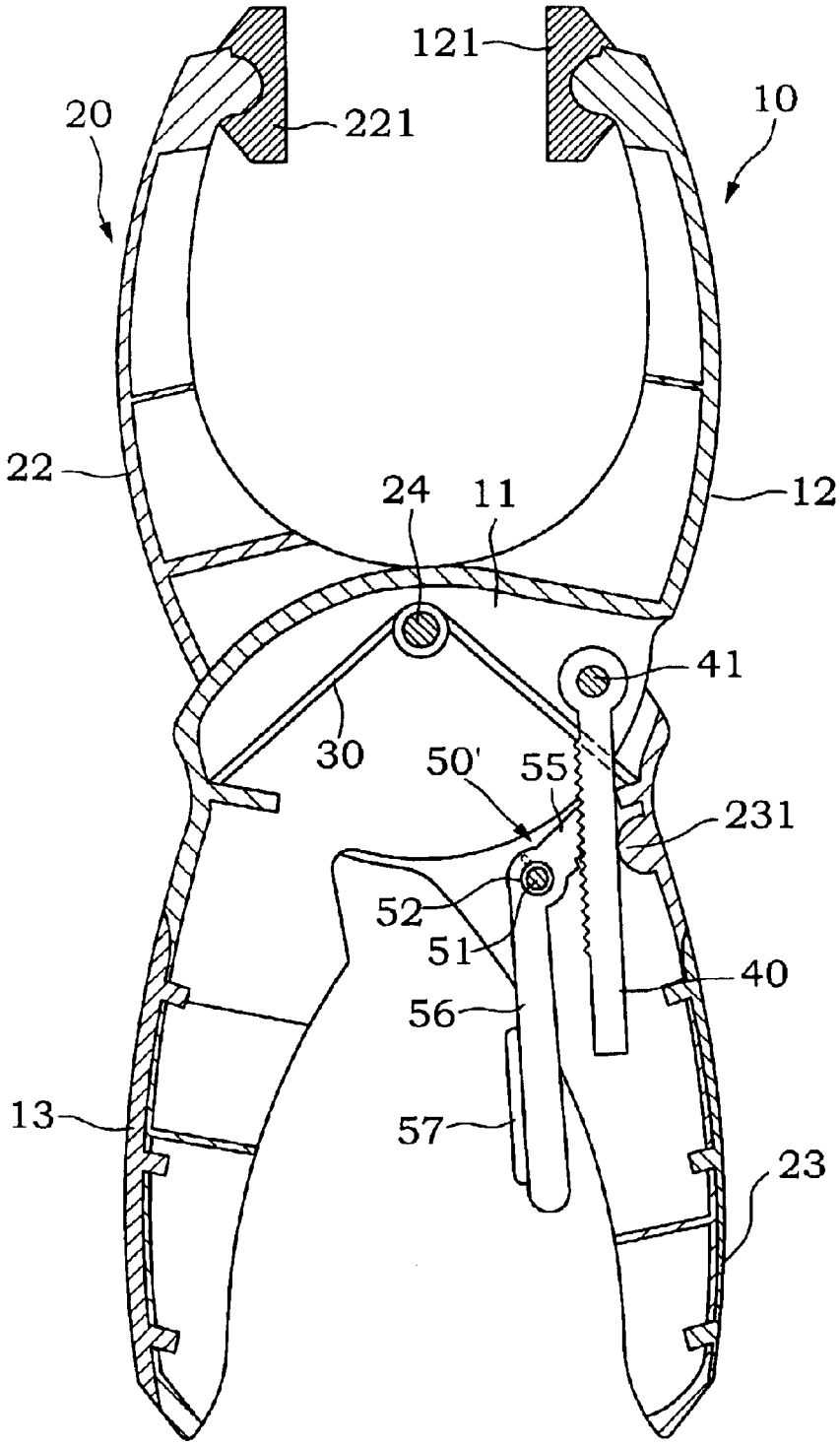
FIG. 6A is a cross-sectional view (I) of the second application of the present invention.
Figure 6B:
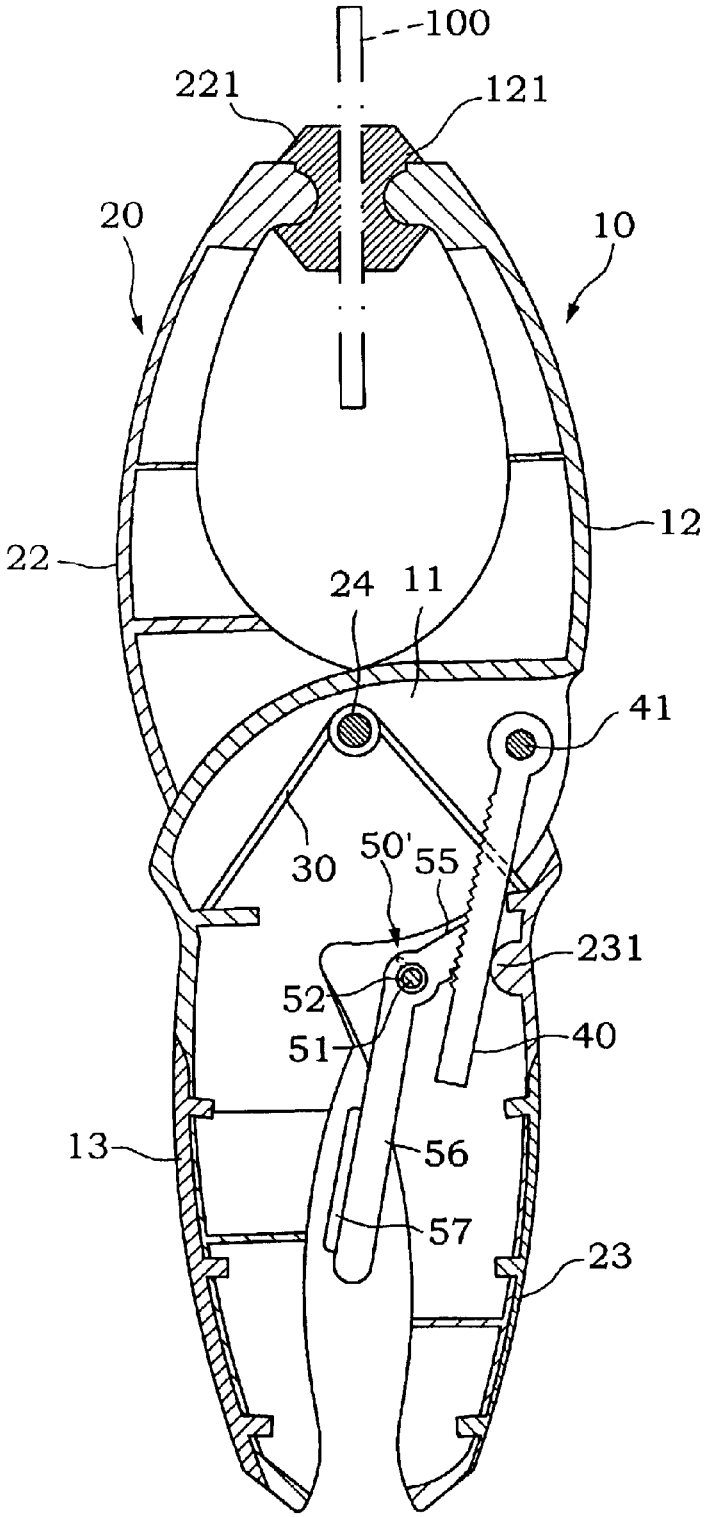
FIG. 6B is a cross-sectional view (II) of the second application of the present invention.
Figure 6C:
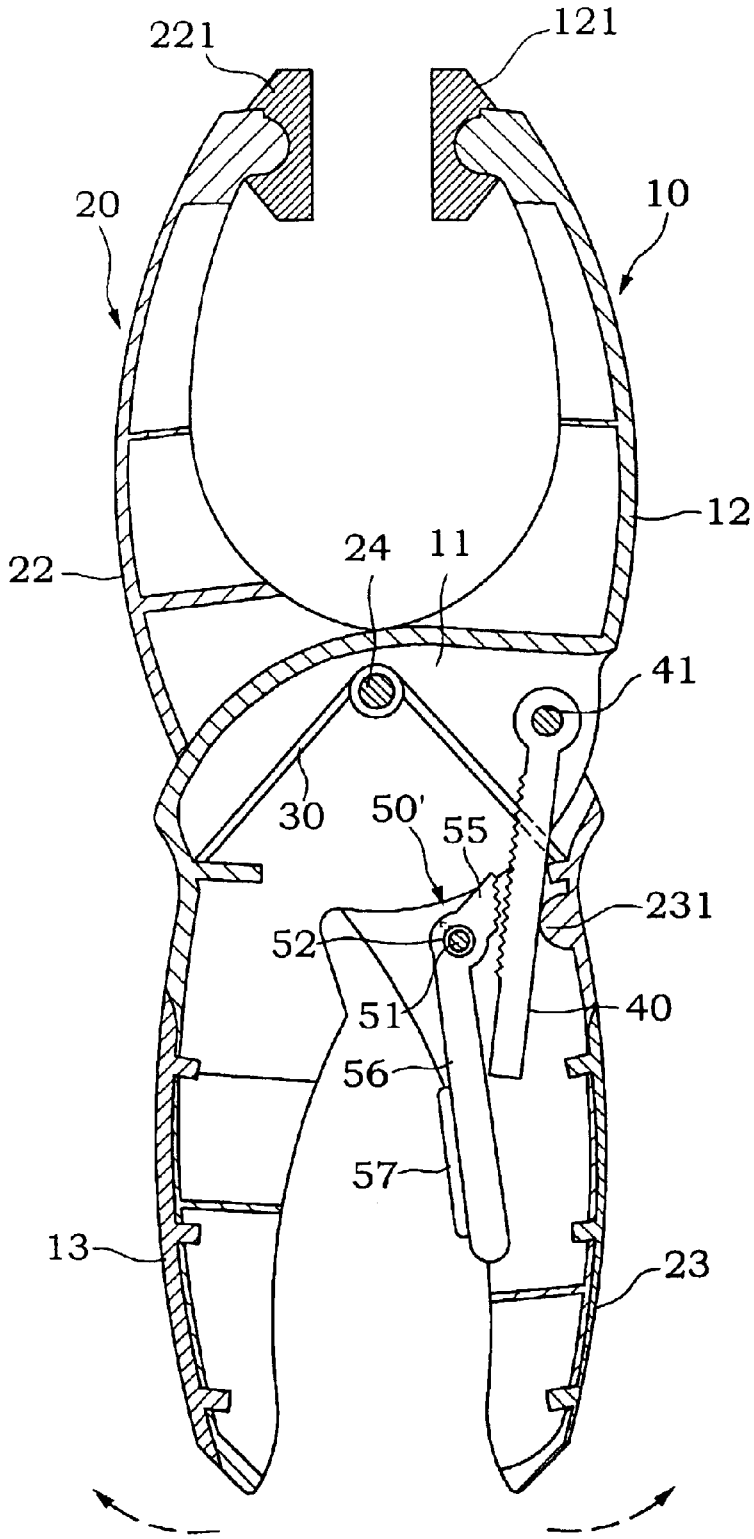
FIG. 6C is a cross-sectional view (III) of the second application of the present invention.

The second application as shown in FIG. 6A, FIG. 6B and FIG. 6C, the front of the control mechanism (50') is linked moveably to the handle (23) that face the teeth side of the teeth bar (40) with a rivet (51) and a spring (52), the end of the control mechanism (50') stretches downward and forms a long stern (56), an adjust part (57) is at the end of the long stem (56), the adjust part (57) stretches out of the present invention for users to press with thumb easily; the teeth structure (55) of the control mechanism (50') faces the teeth bar (40), the teeth structure (55) normally gears into the teeth of the teeth bar (40) by the elastic strength of the spring (52), the teeth bar (40) is also pulled toward the protuberance (231).

Figure 3A:
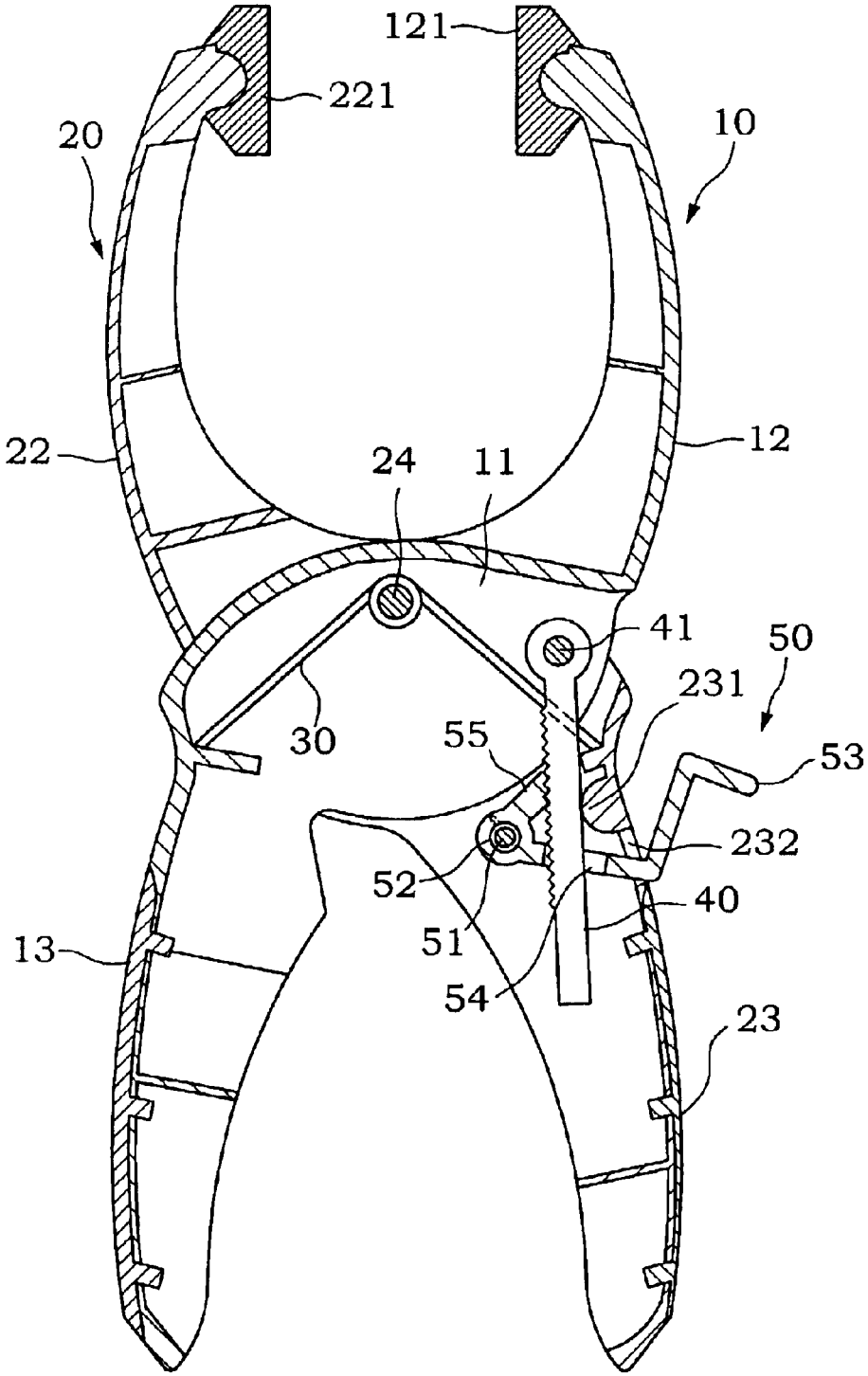
FIG. 3A is a cross-sectional view (I) of the first application of the present invention.
Figure 3B:
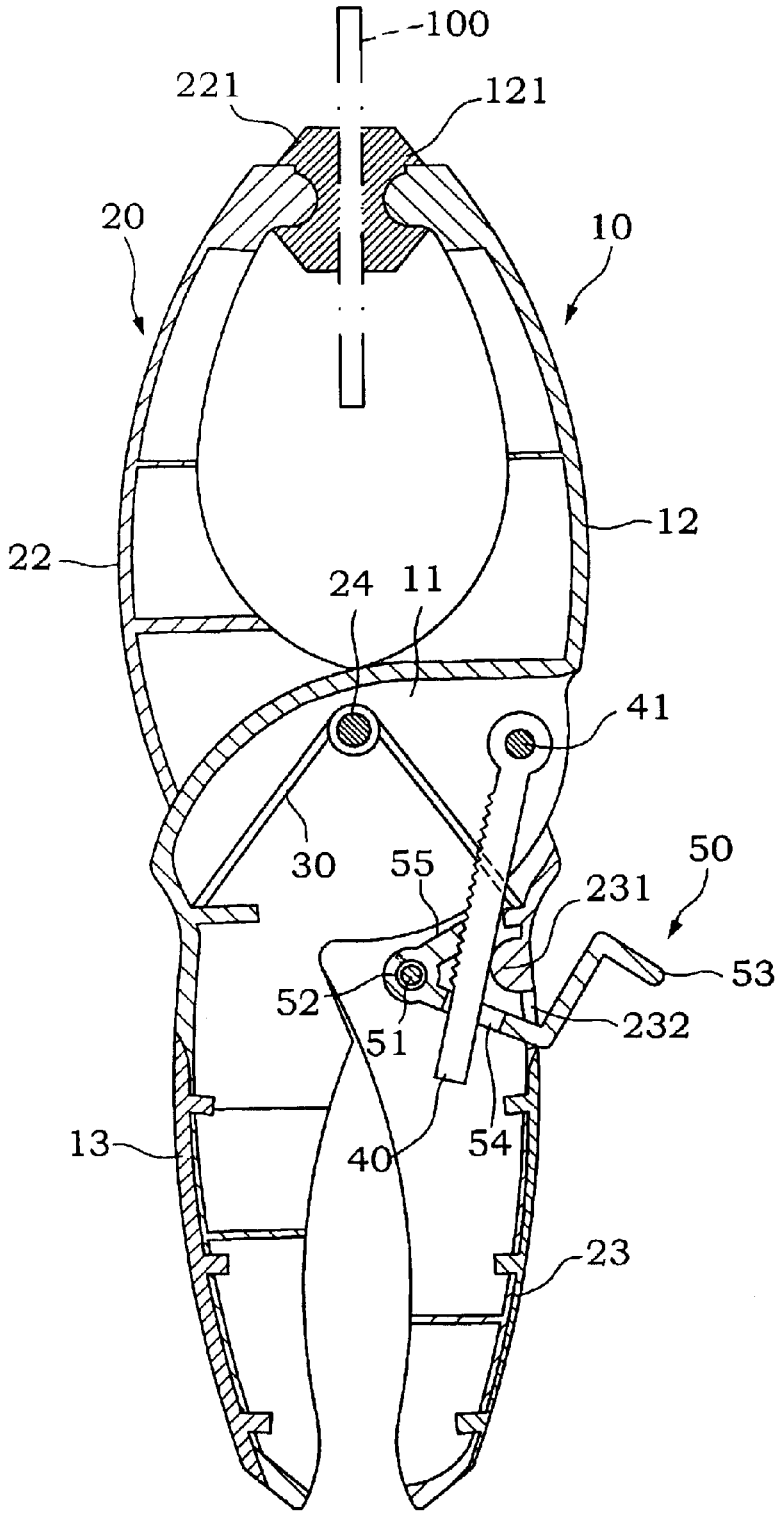
FIG. 3B is a cross-sectional view (II) of the first application of the present invention.
Figure 3C:
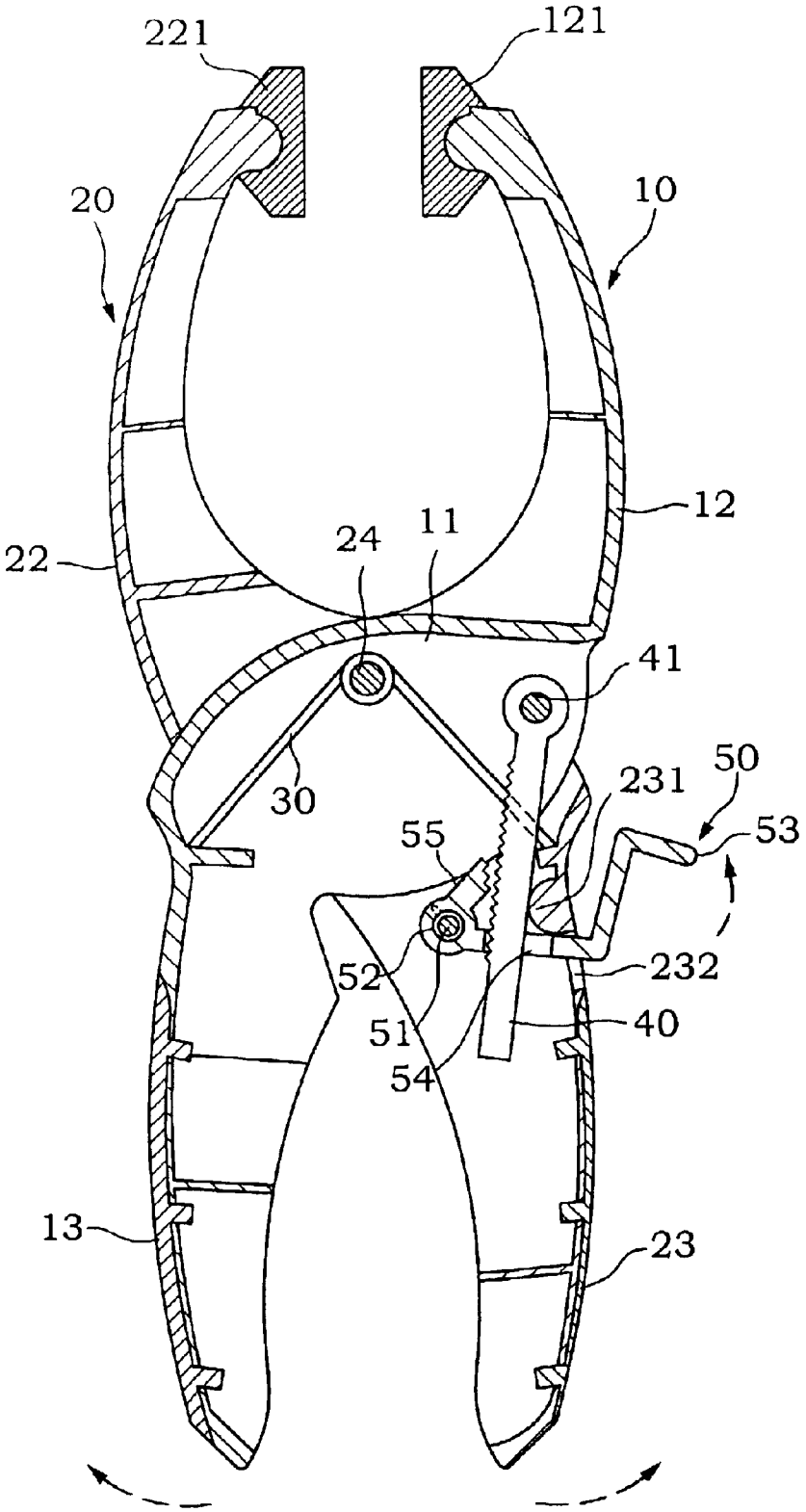
FIG. 3C is a cross-sectional view (III) of the first application of the present invention.
Figure 4:
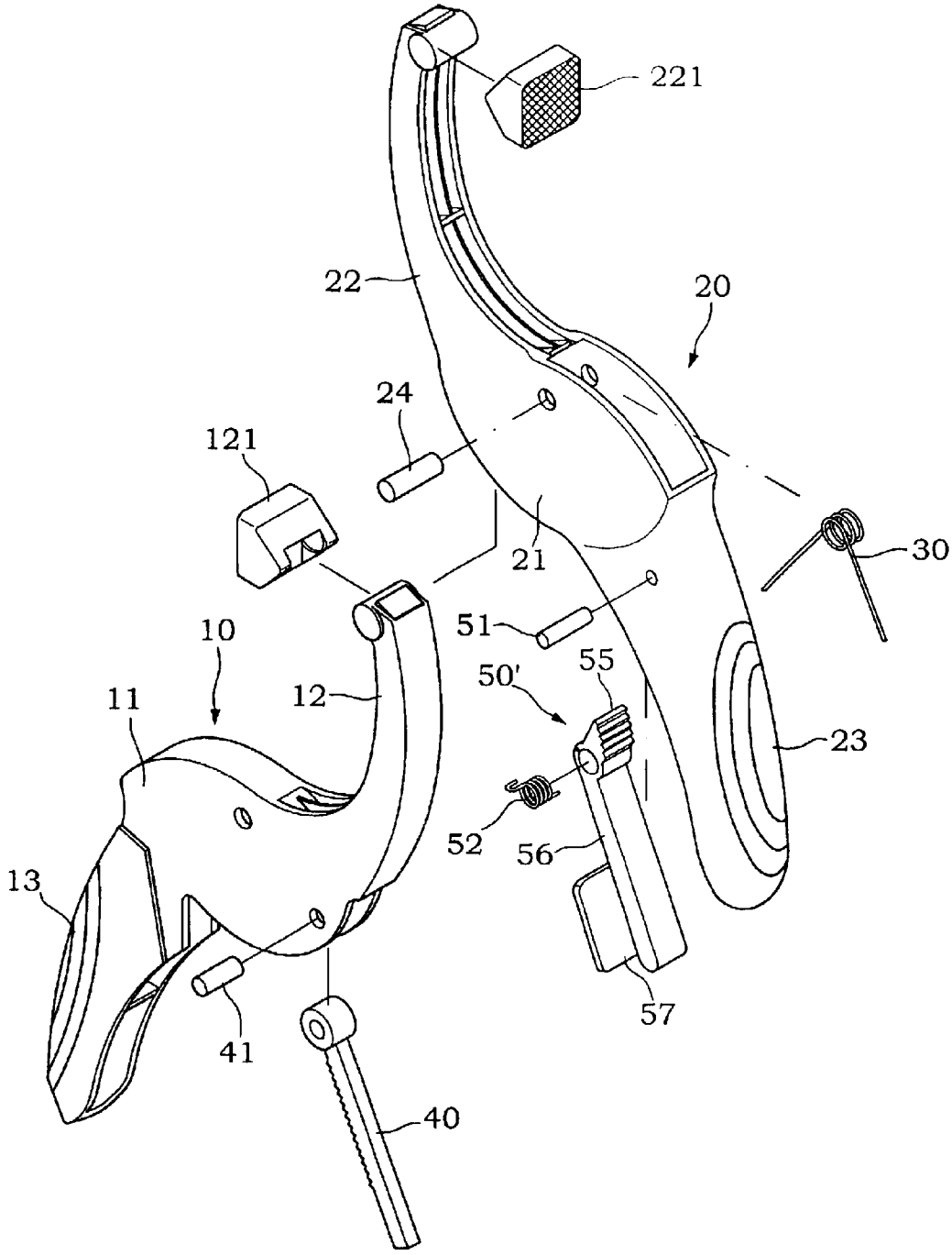
FIG. 4 is an assembly view of the second application the present invention.
Figure 5:
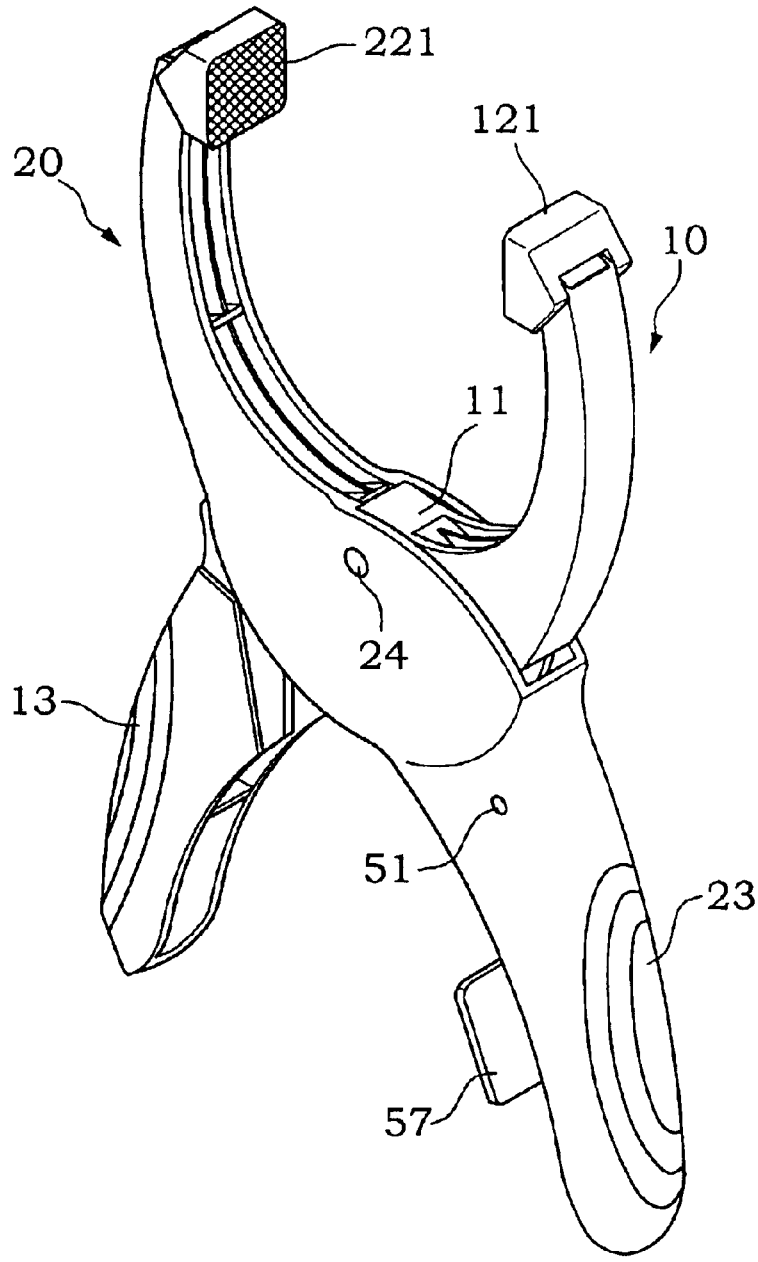
FIG. 5 is a perspective of the second application of the present invention.

Referring to FIG. 3A and FIG. 3B, the first application of the present invention, users can grip two handle (13), (23) and press tensile spring (30), two jaw (12), (22) clamp a object (100) with two jaw tip (121), (221). At the same time, the teeth bar (40) is lifted up because the two handle (13), (23) change the angle, the control mechanism (50) also inclines along, the long hole (54) offers the moveable room. The teeth bar (40) moves up along the teeth side of the teeth structure (55) of the control mechanism (50). While users grip to the end, the teeth structure (55) and the teeth bar (40) will gear together firmly in reverse direction, the teeth bar (40) can not move downward further to maintain the jaw (12), (22) in tight clamping condition and to hold the object (100) firmly. When the object (100) is to be released, as shown in FIG. 3C, users can apply thumb of the gripping hand to push the control mechanism (50) to separate the teeth bar (40) and the teeth structure (55), the two handle (13), (23) will be opened by the tensile spring (30), the two jaw (12), (22) release the object (100).

Referring to FIG. 6A and FIG. 6B, the second application of the present invention, users can grip two handle (13), (23), the teeth bar (40) is lifted up because the two handle (13), (23) change the angle, the control mechanism (50') also inclines along, the long stem (56) and the adjust part (57) swing out to the middle of the two handle (13), (23). The teeth bar (40) moves up along the teeth side of the teeth structure (55). While users grip to the end, the teeth structure (55) and the teeth bar (40) will gear together firmly in reverse direction, the teeth bar (40) can not move downward further to maintain the jaw (12), (22) in tight clamping condition and to hold the object (100) firmly. As shown in FIG. 6C, users can apply thumb of the gripping hand to push the adjust part (57) to separate the teeth bar (40) and the teeth structure (55) of the control mechanism (50'), the two handle (13), (23) will be opened by the tensile spring (30), the two jaw (12), (22) release the object (100).

The control mechanism (50), (50') of the first and second application of the present invention has the merit of the longer lever arm. The rivet (51) is the supporting point, the lever arm from the supporting point to the adjust part (53), (57) is longer than the lever arm from supporting point to the teeth structure (55), therefore users can push the adjust part (53), (57) slightly to separate the teeth structure (55) and the teeth bar (40) to achieve the ease of control and ease of open, close of the present invention effect.

Based on above description, users can control the clamping effect by adjusting the gearing operation of the control mechanism (50), (50') and the teeth bar (40) to maintain the clamping condition easily without extra effort even in moving the object (100), such scheme can achieve ease of gripping and continuous, stable of clamping. While release the object (100), users can just press the adjust part (53), (57), such operation will let users maintain ease of control when the handle (13), (23) open, the object (100) is tend to be more stable when released.

While a preferred embodiment of the invention has been shown and described in detail, it will be readily understood and appreciated that numerous omissions, changes and additions may be made without departing from the spirit and scope of the invention.

What is claimed is:

1. A locking pliers comprising:

a first arm with a joint in hollow center, two sides of said first arm is a jaw and a handle;

a second arm with a joint in hollow center, two sides of said second arm is a jaw and a handle, a main rivet joins said first arm and said second arm together in cross;

a tensile spring wrapping around said main rivet with two legs inside said handles respectively;

a teeth bar in rectangular shape with one end joining moveably inside said joint of said first arm, the other end stretching downward into said handle of said second arm;

a control mechanism with a teeth structure located on one side to gear into the teeth of said teeth bar and to offer an elastic strength to pull said teeth bar toward the inner wall of said second arm, the other side stretches out of said handle of said second arm wherein said control mechanism is linked moveably to said handle that face the teeth side of said teeth bar with a rivet and a spring.

2. The locking pliers recited in claim 1, wherein the end of said control mechanism passing through a hole of said handle and forming an adjust part.

3. The locking pliers recited in claim 2, wherein said adjust part being bent from the body of said control mechanism.

4. The locking pliers recited in claim 3, wherein the middle of said control mechanism having a long hole for said teeth bar to pass through.

5. The locking pliers recited in claim 1, wherein the end of said control mechanism stretching downward and forming a long stem located between two said handles.

6. The locking pliers recited in claim 5, wherein an adjust part located at the end of said long stem.

7. The locking pliers recited in claim 6, wherein said adjust part stretching in an outward direction for users to press with thumb.

* * * * *